US007748396B2

(12) United States Patent
Lasota

(10) Patent No.: US 7,748,396 B2
(45) Date of Patent: Jul. 6, 2010

(54) ANTI-SLIP CRUTCH TIP APPARATUS AND METHOD

(75) Inventor: James E. Lasota, Simsbury, CT (US)

(73) Assignee: Gary S. Lasota, Saratoga Springs, NY (US)

( * ) Notice: Subject to any disclaimer, the term of this patent is extended or adjusted under 35 U.S.C. 154(b) by 0 days.

(21) Appl. No.: 12/124,740

(22) Filed: May 21, 2008

(65) Prior Publication Data

US 2009/0288693 A1 Nov. 26, 2009

(51) Int. Cl.
*A45B 9/04* (2006.01)

(52) U.S. Cl. ..... 135/77

(58) Field of Classification Search ..... 135/77, 135/82, 84, 86
See application file for complete search history.

(56) References Cited

U.S. PATENT DOCUMENTS

| | | | | | |
|---|---|---|---|---|---|
| 1,313,422 | A | * | 8/1919 | Snyder | 135/86 |
| 1,340,616 | A | | 5/1920 | Lynde | |
| 1,340,617 | A | | 5/1920 | Lynde | |
| 1,411,200 | A | * | 3/1922 | Garza | 36/7.8 |
| 1,429,428 | A | | 9/1922 | Hipwood | |
| 2,403,632 | A | | 7/1946 | Brown | |
| 2,857,925 | A | * | 10/1958 | Stopford | 135/86 |
| 2,888,022 | A | * | 5/1959 | Fanning | 135/82 |
| 2,910,995 | A | | 11/1959 | Jacuzzi | |
| 3,251,372 | A | * | 5/1966 | Smith | 135/86 |
| 3,467,117 | A | * | 9/1969 | Lucibello | 135/77 |
| 3,731,698 | A | | 5/1973 | Buchalter | |
| 4,098,283 | A | | 7/1978 | Tritle, Jr. | |
| 4,135,536 | A | * | 1/1979 | Willis | 135/84 |
| 4,440,186 | A | | 4/1984 | Lottner | |
| 4,562,851 | A | | 1/1986 | Frank | |
| 4,881,564 | A | | 11/1989 | Fetterman | |
| 5,178,176 | A | | 1/1993 | Fetterman | |
| D359,162 | S | | 6/1995 | Knight | |
| 5,826,606 | A | | 10/1998 | Davenport | |
| D417,070 | S | | 11/1999 | Wyler | |
| 6,024,110 | A | * | 2/2000 | Renfro | 135/66 |
| 6,138,699 | A | | 10/2000 | Su | |
| 6,279,592 | B1 | * | 8/2001 | Yamamoto | 135/77 |
| 6,374,841 | B1 | | 4/2002 | Yamamoto et al. | |
| 6,883,530 | B2 | | 4/2005 | Kawakami | |

* cited by examiner

*Primary Examiner*—David Dunn
*Assistant Examiner*—Noah Chandler Hawk
(74) *Attorney, Agent, or Firm*—Schmeiser, Olsen & Watts, LLP

(57) ABSTRACT

Provided is an anti-slip crutch tip apparatus that includes at least one vent opening, located on the side wall of a generally cylindrical section of a crutch tip body and extending into the tip body, so that the vent opening is surrounded by structure forming a portion of the generally cylindrical section of the tip body The at least one vent opening is in physical communication with a portion of at least one channel formed into a surface contact portion of the tip body, so that an unbroken fissure in the tip body resides as a structural breach extending between the side-wall entrance of the at least one opening and the physically communicative association of the at least one vent opening with the portion of the at least one channel. A corresponding method of preventing slipping of a support device tip is also provided.

22 Claims, 5 Drawing Sheets

(Prior Art)

ANTI-SLIP CRUTCH TIP APPARATUS AND METHOD

BACKGROUND OF THE INVENTION

1. Technical Field

This invention relates generally to an apparatus and method for preventing slipping of crutch tips, cane tips, walker feet tips, and/or tips of other similar support devices. More particularly, this invention provides a support device comprising a side-wall vented tip configuration for relieving pressure buildup to prevent the support device tip from hydroplaning sideways on a wet, icy, or otherwise slick surface. A corresponding method of preventing slipping of a support device tip is also provided.

2. Related Art

Crutches, canes, walkers, and other similar support devices have been used for many years by numerous individuals in need of motive assistance and physical support. When an individual utilizes such a device for motive assistance, it is critical that the physical support provided by the device is steadfast during operation of the device, so that the individual can safely rely on the assistance of the device without risk of injury. Reliable support is especially important when the support device is employed on wet, icy, or otherwise slick surfaces because such surface conditions may cause the tip of the support device (hereinafter referred to interchangeably as a crutch tip) to slip sideways causing the user of the device to lose balance and fall possibly leading to injury. Many different crutch tips have been provided to help prevent slipping. However, none of the known tips have adequately alleviated the slipping problem. Accordingly, there is a need for an improved crutch tip device.

SUMMARY OF THE INVENTION

A first aspect of the present invention provides an anti-slip crutch tip apparatus comprising: a tip body, having a first end and an opposing second end, wherein the first end of the tip body includes a crutch leg opening extending axially within a generally frustoconical section of the tip body, the crutch leg opening configured to receive a portion of a crutch leg, and wherein the second end of the tip body includes a surface contact portion located at the extent of a generally cylindrical section of the tip body; tread structures, formed into the surface contact portion of the second end of the tip body, the tread structures including at least one ridge and at least one channel; and at least one vent opening, the at least one vent opening located on the side wall of the generally cylindrical section of the tip body and extending into the generally cylindrical section of the tip body, so that the at least one vent opening is surrounded by structure forming a portion of the generally cylindrical section of the tip body; wherein the at least one vent opening is in physical communication with a portion of the at least one channel, so that an unbroken fissure in the tip body resides as a structural breach extending between the generally cylindrical section side-wall entrance of the at least one vent opening and the physically communicative association of the at least one opening with the portion of the at least one channel.

A second aspect of the present invention provides a crutch support tip apparatus for preventing sideways slipping of a crutch support, the crutch support tip apparatus comprising: a tip body, having a crutch leg receiving end, an opposing base support end, and a sidewall that extends between the crutch receiving end and the base support end, the crutch leg receiving end having a top axial opening configured to receive the leg of a crutch support, and the base support end having a bottom diameter that is larger than the diameter of the crutch leg receiving end; a circumferential contact surface, located at the extent of the outermost diameter of the bottom of the base support end, the circumferential contact surface being concaved so that the outer-most edge of the concaved circumferential contact surface forms the perimeter of a suction-cup-like recess of the bottom of the base support end of the tip body; and a relief tunnel situated to extend through the structure of the tip body between the sidewall of the tip body, above the circumferential contact surface, and a portion of a groove formed on the bottom of the base support end, wherein the groove is located radially within the diameter of the circumferential contact surface of the base support end.

A third aspect of the present invention provides a method of preventing slipping of a crutch support device tip, the method comprising: providing an anti-slip crutch tip apparatus including: a tip body, having a first end and an opposing second end, wherein the first end of the tip body includes a crutch leg opening extending axially within a generally frustoconical section of the tip body, the crutch leg opening configured to receive a portion of a crutch leg, and wherein the second end of the tip body includes a surface contact portion located at the extent of a generally cylindrical section of the tip body, the surface contact portion having a circumferential contact surface being concaved so that the outer-most edge of the concaved circumferential contact surface forms the perimeter of a suction-cup-like recess of the extent of the generally cylindrical section of the second end of the tip body; and a relief tunnel situated to extend through the structure of the tip body between the sidewall of the generally cylindrical section of the tip body, above the circumferential contact surface, and a portion of a groove formed on the surface contact portion, wherein the groove is located radially within the diameter of the circumferential contact surface of the second end of the tip body; compressing the circumferential contact surface of the tip body against a crutch support surface; and relieving pressure built-up under the suction-cup-like recess of the extent of the generally cylindrical section of the second end of the tip body by allowing the built-up pressure to escape through the relief tunnel extending between the groove formed on the surface contact portion and the sidewall of the generally cylindrical section of the tip body, thereby preventing hydroplaning and sideways slippage of the crutch tip.

BRIEF DESCRIPTION OF THE DRAWINGS

Some embodiments of this invention will be described in detail, with reference to the following figures, wherein like designations denote like members, wherein.

DETAILED DESCRIPTION OF THE INVENTION

Figure 1:
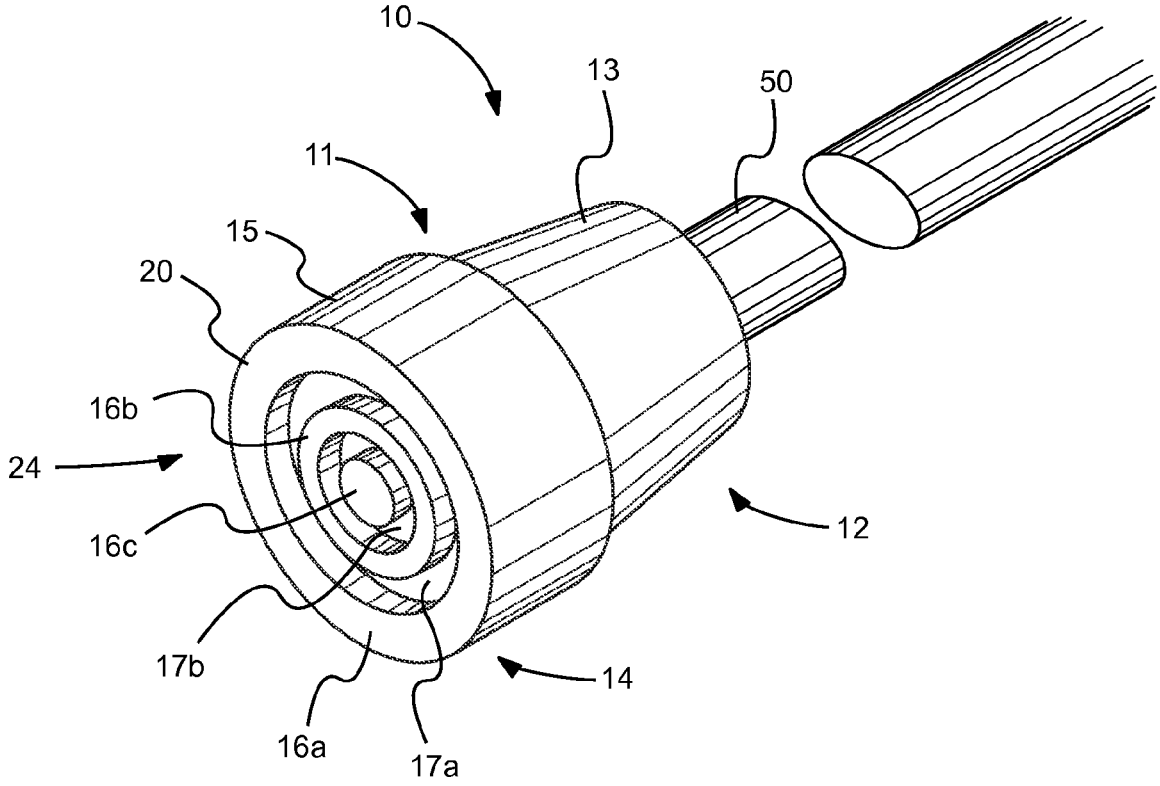
FIG. 1 is a perspective view of standard crutch support tip of the known art.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts a perspective view of standard crutch support tip 10 of the known art. The tip 10 is operable on a common crutch support being a medical device commonly used in the support and rehabilitation of various leg ailments affecting but not restricted to the foot, ankle and knee or as a device to assist with walking. A common crutch support refers to crutches, walkers, canes, etc. The crutch tip 10 is load-bearing device attached to the end portion of the crutch support that is in contact with the ground or other near-horizontal crutch support surface. The standard crutch support tip 10 includes a tip body 11 having a first crutch leg receiving end 12 opposing a second base support end 14. The first crutch receiving end 12 of the tip body 11 typically includes a crutch leg opening (not shown) extending axially within a generally frustoconical section 13 of the tip body 11. The crutch leg opening is normally configured to receive a portion of a crutch leg 50. Additionally, the second base support end 14 of the tip body 11 includes a surface contact portion 20 located at the extent of a generally cylindrical section 15 of the tip body 11. Moreover, tread structures 18 are often formed into the surface contact portion 20 of the second base support end 14 of the tip body 11. The tread structures 18 usually include at least one ridge 17 and at least one channel 16. Furthermore, the second base support end 14 typically has a bottom diameter that is larger than the diameter of the first crutch leg receiving end 12. Known crutch tip devices 10 are generally made out of compliant rubber-like materials with high friction coefficients to help firmly plant the tip devices on the ground or other support surfaces to prevent the crutch support from slipping.

Notably, known crutch tips 10 also have a substantially circumferential contact surface 20, located at the extent of the outermost diameter of the bottom of the second base support end 14. The circumferential contact surface 20 is typically concaved so that the outer-most edge of the concaved circumferential contact surface 20 forms the perimeter of a suction-cup-like recess 24 of the bottom of the second base support end 14 of the tip body 11. Within the suction-cup-like recess 24 may reside the plurality of tread structures 18 that may exist as a plurality of concentric ridges 16*a-c* spaced apart by a corresponding plurality of concentric channels 17*a-b*.

The suction-cup-like recess 24 on the bottom of the surface contact portion 20 of the second base support end 14 of the tip body 11 of a standard crutch tip 10 can trap air or liquid during use. When this occurs, pressure exerted by the individual using the crutch will force the trapped air or liquid to pass between the surface contact portion 20 of the crutch tip 10 base support end 14 and the ground or other near-horizontal support surface onto which the crutch tip 10 has been placed. The passage of this trapped air or liquid will in turn act to reduce the friction between the second base support end 14 of the crutch tip 10 and the ground causing an increase in slippage. Slippage is when a condition where the friction between the crutch tip 10 and the ground diminishes to the point where a potential safety hazard to the individual using the crutch exists because the tip 10 may tend to hydroplane or otherwise slip horizontally causing a loss of support. This can be understood further by considering the representative physical analogy of a suction cup placed on a flat window pane. Although the suction cup may be firmly secured to the surface of the glass window pane, the cup can be easily and readily moved in any horizontal direction by pushing and providing a lateral force. There is relatively little lateral friction existent between the suction cup and the window. Thus, the suction cup can be slid around on the window pane even while it is firmly vacuum attached thereto. Similar lateral slippage can occur when pressure builds under the recess of a standard crutch tip 10; the tip 10 may be firmly pressed to the ground, yet still have very little lateral resistance to stop horizontal slippage because of air or water that squeezes past the contact surfaces 20 and reduces friction. Furthermore, as a standard crutch tip 10 becomes subject to normal wear, the depth of the suction-cup-like recess 24 in the second base support end 14 of the crutch tip 10 will decrease. On wet ground this worn condition reduced depth also leads to quicker build up of pressure and an increase in slippage potential.

Figure 2:
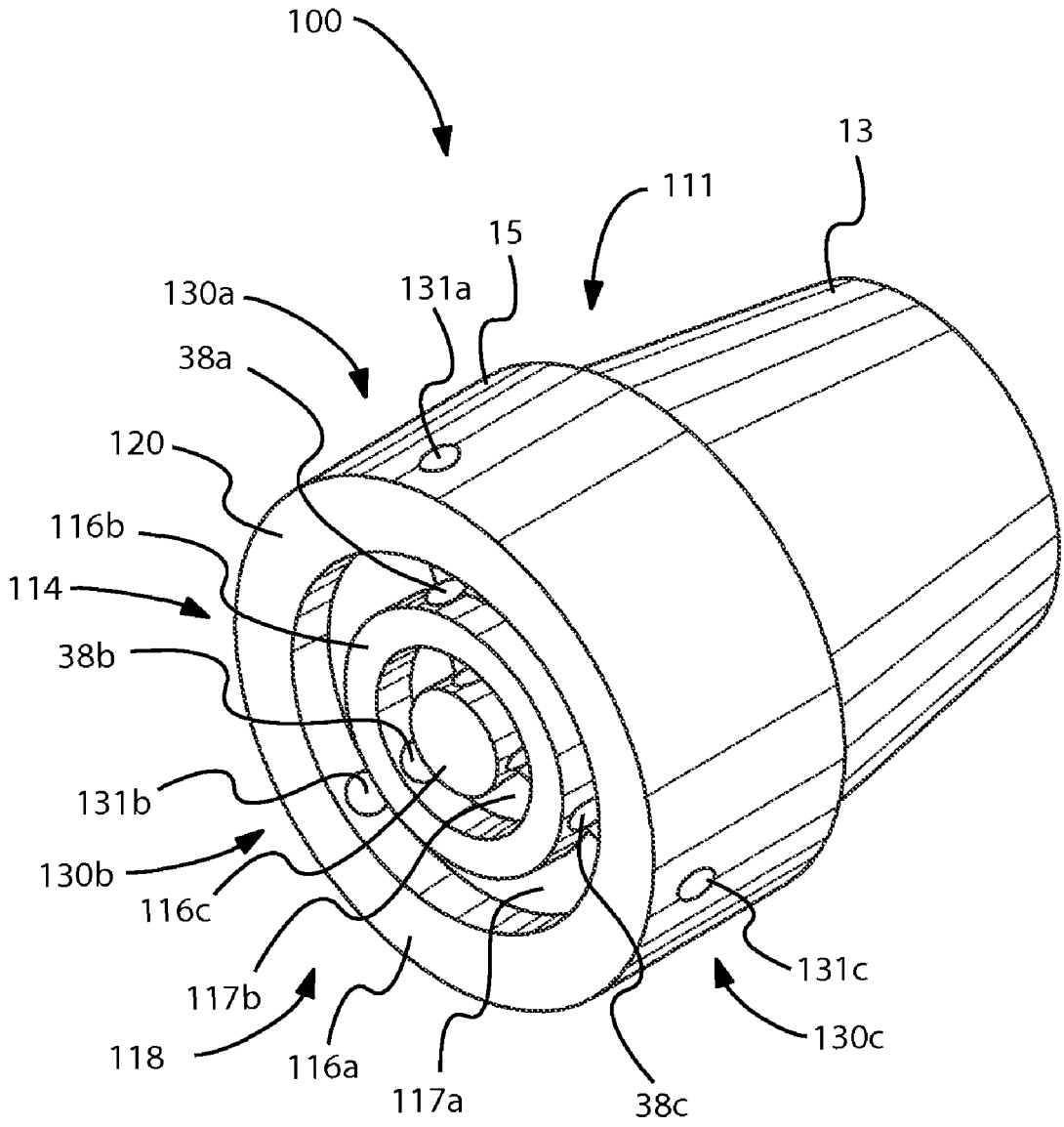
FIG. 2 is a perspective view of an embodiment of an anti-slip crutch tip apparatus, in accordance with the present invention.

Embodiments of the present invention are aimed are reducing slippage potential and preventing slipping. Referring further to the drawings, FIG. 2 depicts a perspective view of an embodiment of an anti-slip crutch tip apparatus 100 having pressure relief tunnels 130 including vent openings 131 located on the side of the tip body 111. Similar with standard crutch tip designs 10, embodiments of an anti-slip crutch tip 100 are operable on a common crutch support being a medical device commonly used in the support and rehabilitation of various leg ailments affecting but not restricted to the foot, ankle and knee or as a device to assist with walking. Anti-slip crutch tip embodiments 100 are anti-slip devices attached to the end portions of standard crutches. The anti-slip crutch tip embodiments 100 are designed to contact the ground or other near-horizontal support surfaces during crutch operation. An anti-slip crutch support tip 100 includes a tip body 111 having a first crutch leg receiving end 112 opposing a second base support end 114. The first crutch receiving end 112 of the tip body 111 includes a crutch leg opening 119 (see FIG. 5) extending axially within a generally frustoconical section 113 of the tip body 111. The crutch leg opening 119 is configured to receive a portion of a crutch leg 50 (see FIG. 1). Additionally, the second base support end 114 of the tip body 111 includes a surface contact portion 120 located at the extent of a generally cylindrical section 115 of the tip body 111. Moreover, tread structures 118 are formed into the surface contact portion 120 of the second base support end 114 of the tip body 111. The tread structures 118 may include at least one ridge 17 and at least one channel or groove 116. Furthermore, the second base support end 114 has a bottom diameter $d_2$ that is larger than the top diameter $d_1$ of the first crutch leg receiving end 112 (see FIG. 3). Preferably, anti-slip crutch tip device embodiments 100 are made out of compliant rubber-like materials with high friction coefficients to help firmly keep the tip devices 100 in contact with the ground or other support surfaces to prevent the crutch tip devices 100 from slipping.

Embodiments of an anti-slip crutch tip 100 should include a relief tunnel, such as tunnels 130*a-c*, situated to extend through the structure of the tip body 111 between the sidewall of the tip body 111, above the circumferential contact surface 120, and a portion of a groove or channel, such as channels 117*a-b*, formed on the bottom of the second base support end 114, wherein the groove or channel 117 is located radially within the diameter of the circumferential contact surface 120 of the second base support end 114 of the anti-slip crutch tip body 111. Those in the art should appreciate that the groove or channels may be located in other positions and may not need to be annularly shaped ring-like structures with radial axial location. The relief tunnel 130 may extend at any angle into the top body 111, so long as it intersects a portion of a groove or channel 117. Correlatively, embodiments of an anti-slip crutch tip 100 should include at least one vent opening, such as vent openings 131*a-c*, wherein the at least one vent opening 131 is located on the side wall of the generally cylindrical section 115 of the tip body 111. The at least one opening 131 extends into the generally cylindrical section 115 of the tip body 111, so that the at least one vent opening 131 is surrounded by physical structure forming a portion of the generally cylindrical section 115 of the tip body 111. In addition, the at least one vent opening 131 should be in physical communication with a portion of the at least one groove or channel 117, so that an unbroken fissure in the tip body 111 resides as a structural breach extending between the generally cylindrical section 115 side-wall entrance of the at least one opening 131 and the physically communicative association of the at least one opening 130 with the portion of the at least one groove or channel 117.

Figure 3:
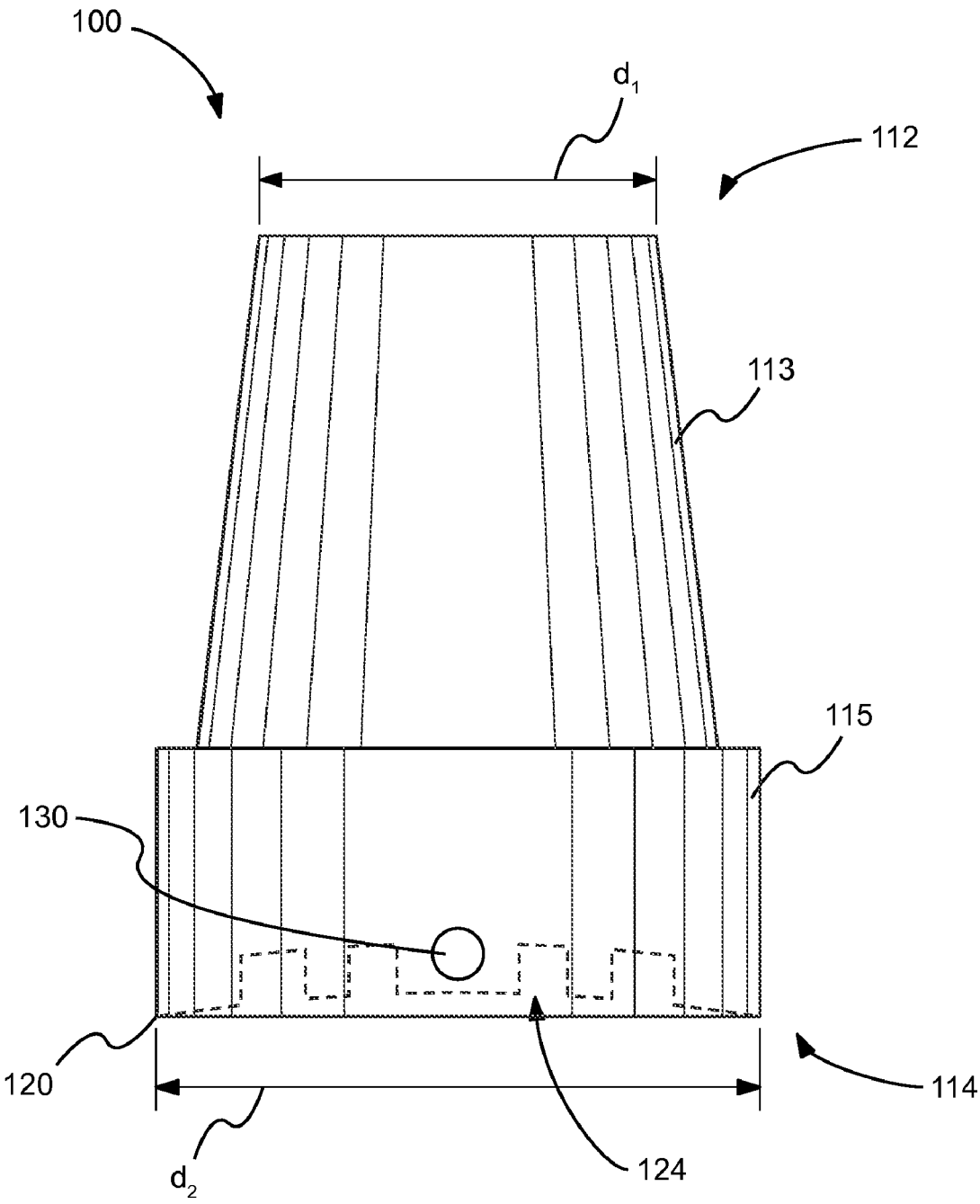
FIG. 3 is a side view of an embodiment of an anti-slip crutch tip apparatus, in accordance with the present invention.

As further shown in FIG. 3, which depicts a side view of an embodiment of an anti-slip crutch tip apparatus 100, the crutch tip apparatus 100 may have a substantially circumferential contact surface 120, located at the extent of the outermost diameter of the bottom of the second base support end 114. As depicted the contact surface 120 is relatively flat so that it can make associative contact with the ground or another near-horizontal support surface. The circumferential contact surface 120 is typically concaved so that the outer-most edge of the concaved circumferential contact surface 120 forms the perimeter of a suction-cup-like recess 124 of the bottom of the second base support end 114 of the tip body 111 (see dashed hidden lines of FIG. 3 or corresponding depicted features in FIG. 5). The diameter $d_2$ of the contact surface portion 120 of the second base support end 114 of the tip body 111 may be larger than the diameter $d_1$ of the top portion of the first crutch receiving end 112 of the tip body 111. Within the suction-cup-like recess 124 may reside the plurality of tread structures 118 that may exist as a plurality of concentric ridges 116*a-c* spaced apart by a corresponding plurality of concentric channels 117*a-b*, as shown clearly in FIG. 4, which depicts a bottom view of an embodiment of an anti-slip crutch tip apparatus.

Figure 4:
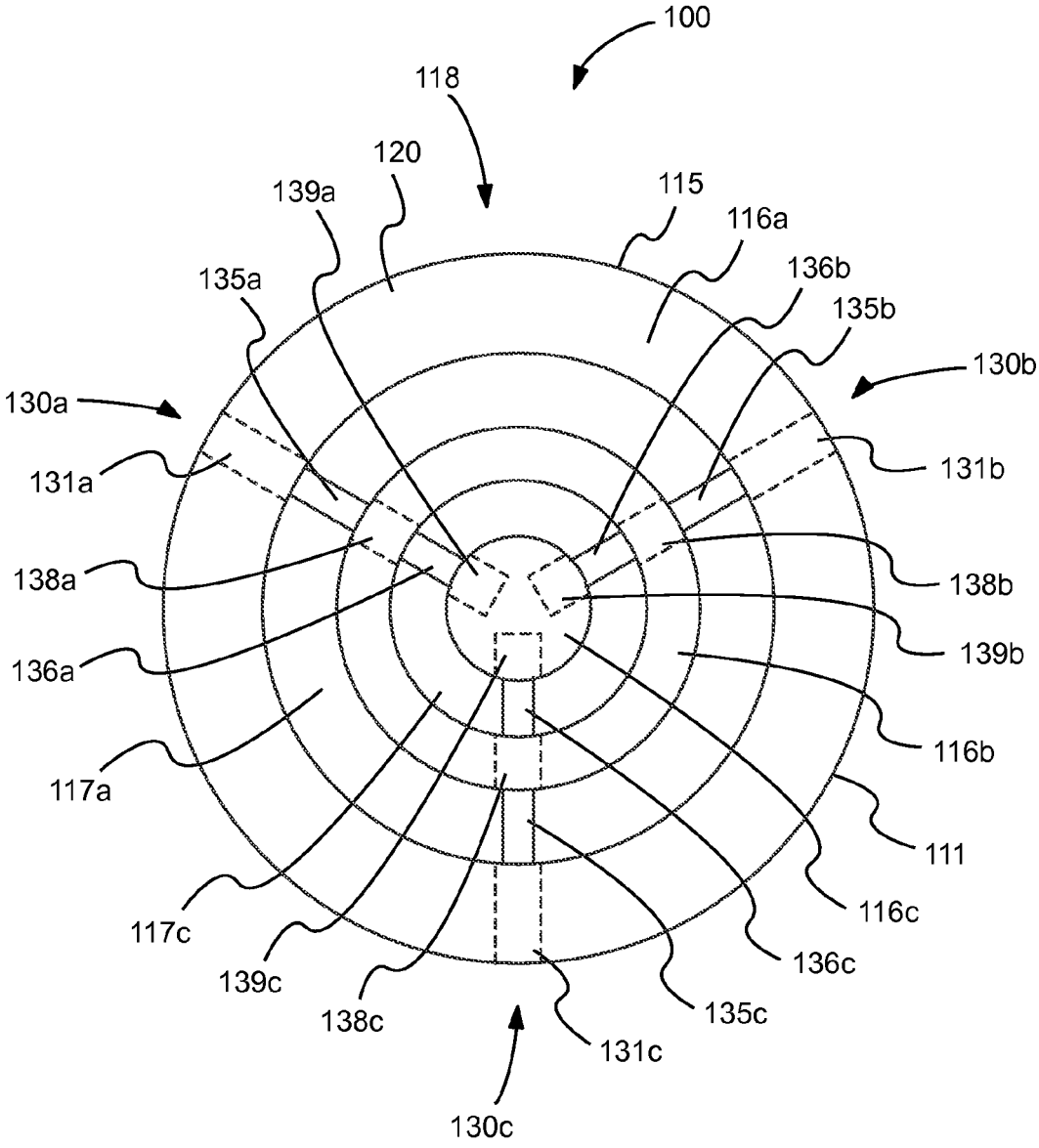
FIG. 4 is a bottom view of an embodiment of an anti-slip crutch tip apparatus, in accordance with the present invention

As further depicted in FIG. 4, the tread structures 118, of an anti-slip crutch tip 100 may include a plurality of ridges or raised surfaces 116*a-c* and a plurality of channels or grooves 117*a-b*. Moreover, embodiments of an anti-slip crutch tip apparatus 100 may also include a plurality of vent openings 131*a-c*, wherein each vent opening 131 is located on the side wall of the generally cylindrical section 115 of the tip body 111. Each of the plurality of vent openings, such as openings 131*a-c*, may extend into the generally cylindrical section 115 of the tip body 111, wherein each vent opening 131*a-c* is in physical communication with a corresponding portion, such as portions 135*a-c* and 136*a-c*, of at least one channel 117 of the plurality channels 117*a-b*. Furthermore, each vent opening, such as opening 131*a*, of the plurality of vent openings 130*a-c* may be equidistantly spaced from other vent openings, such as openings 131*b-c*, located on the side wall of the generally cylindrical section 115 of the tip body 111. However, the plurality of vent openings 131 do not need to be equidistantly spaced, but may be located at any location on the side wall of the generally cylindrical section 115 of the tip body 111 and may extend at any angle into the generally cylindrical section 115 of the tip body 11, so as to contact at least one groove or channel 117. Still further, the plurality of tread structures 118 may include a plurality of concentric ridges 116 spaced apart by a corresponding plurality of concentric grooves or channels 117. Each vent opening 131 of the plurality of vent openings 131*a-c* may extend toward the central axis of the generally cylindrical section 115 of the tip body 111 and each vent opening may terminate at a near axial location, such as at locations 139*a-c*, prior to communicatively intersecting any other vent opening 131 near the central axis. However, the vent openings, as long as there is contact with a groove or channel 117, may extend in any direction through the cylindrical body 115 and may even pass completely through the body and exit at another location of the sidewall of the cylindrical body 115 effectively forming another bent opening.

Figure 5:
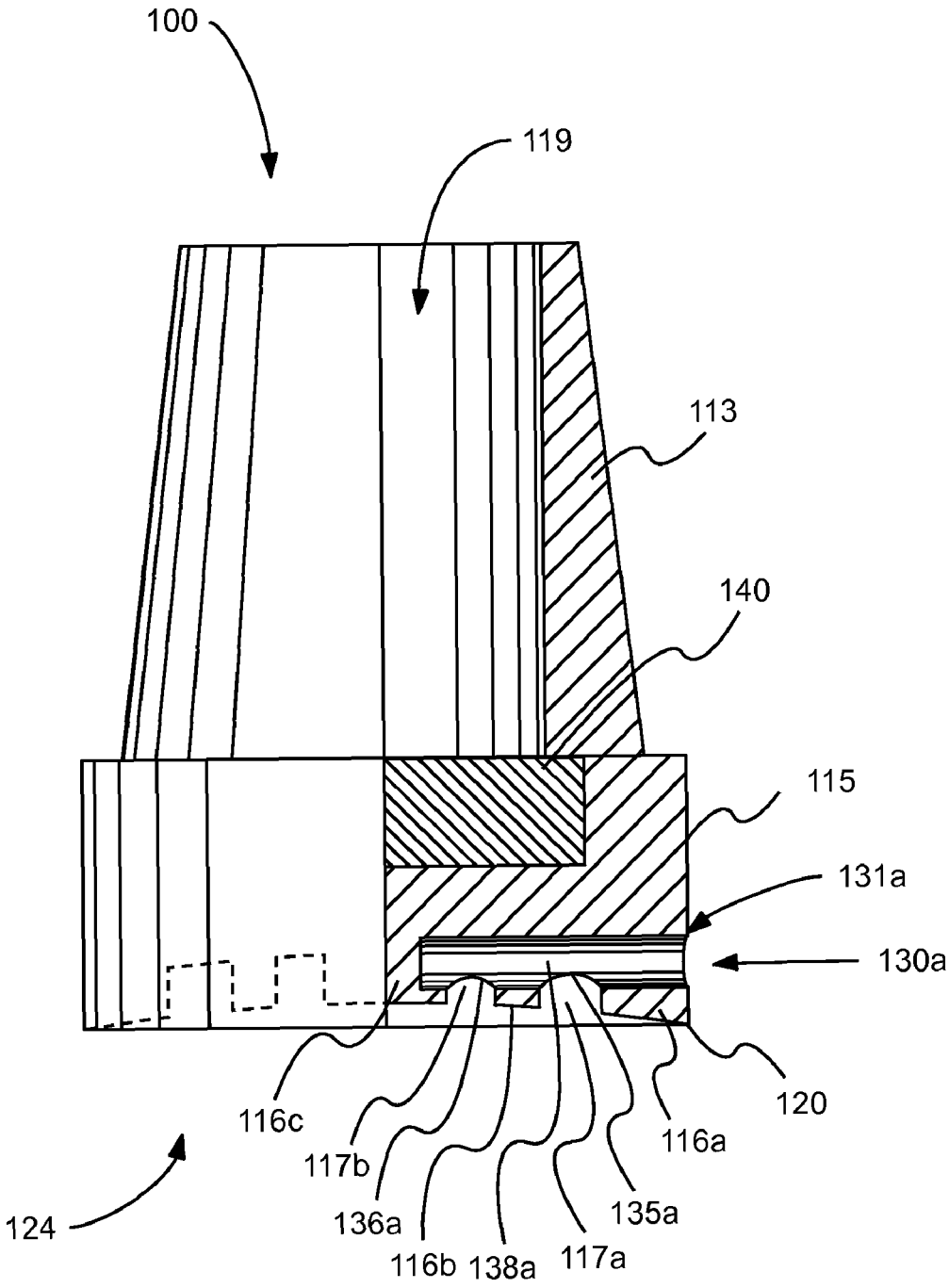
FIG. 5 is a partial cross-section side view of an embodiment of an anti-slip crutch tip apparatus, in accordance with the present invention.
Figure 1:
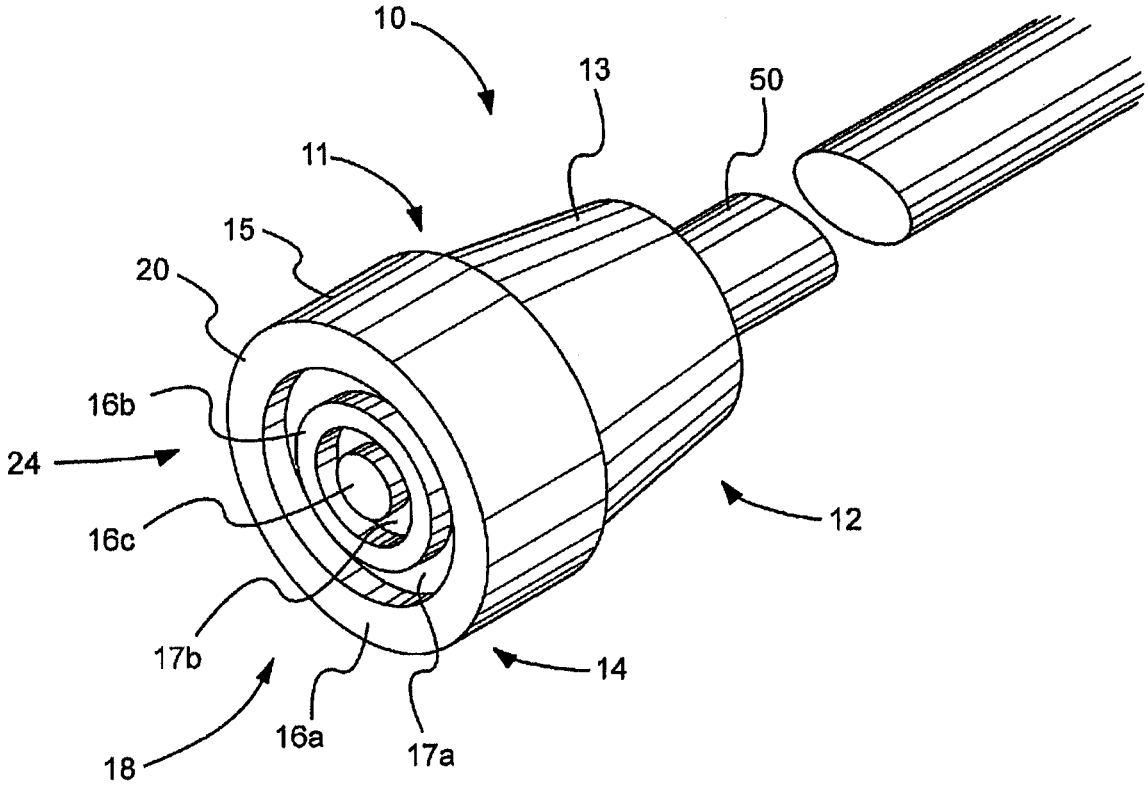
Figure 4:
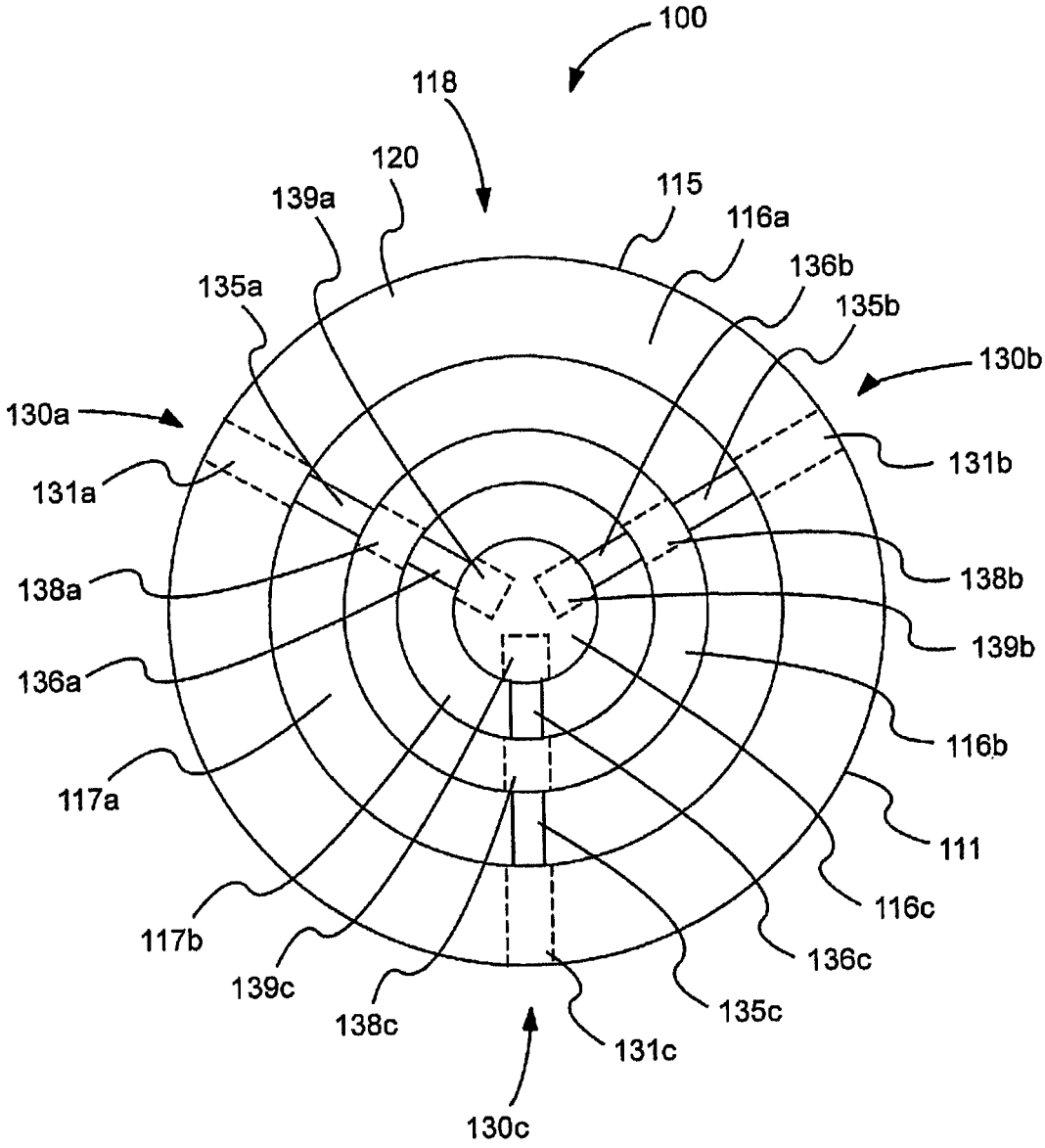

With continued reference to the drawings, FIG. 5 depicts a partial cross-section side view of an embodiment of an anti-slip crutch tip apparatus 100. As shown, a ridge 116*a* of the plurality of ridges 116*a-c* is integral with the side wall of the generally cylindrical section 115 of the tip body 111. The integral ridge 116*a* may be concaved so that the outer-most edge of the concaved ridge 116*a* resides as the extent of the second base support end 114 of the tip body 111 and forms a suction-cup-like recess 124 of the contact surface portion 120 of the second base support end 114 of the tip body 111.

As further depicted in FIG. 5, embodiments of an anti-slip crutch tip apparatus 100 may include a rigid insert 140. The rigid insert 140 may be formed of aluminum or other lightweight rigid materials that may be operable to abut against and support a crutch leg 50 (see FIG. 1) as it is inserted into the crutch leg opening 119. The rigid insert 140 may serve to strengthen a portion of the anti-slip crutch tip apparatus 100. The cross-section view of FIG. 5 clearly shows the relief tunnel 130 as it interacts with the grooves or channels 117*a-b* and facilitates pressure relief therethrough. Additionally the side wall placement of the vent opening 131*a* is depicted and reveals the structural contact surface portion 120 of the integral ridge 116*a* as being pierced by the relief tunnel 130*a*. Accordingly, liquid or air pressure, possibly built up during operation of the crutch tip apparatus 100 can escape through the vent opening 131*a*.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention.

What is claimed is:

1. An anti-slip crutch tip apparatus comprising:

a tip body, having a first end and an opposing second end, wherein the first end of the tip body includes a crutch leg opening extending axially within a generally frustoconical section of the tip body, the crutch leg opening configured to receive a portion of a crutch leg, and wherein the second end of the tip body includes a recess and a circumferential contact surface portion located at the extent of a generally cylindrical section of the tip body;

tread structures, formed within the recess of the second end of the tip body, the tread structures including at least one ridge and at least one channel; and at least one vent opening, the at least one vent opening located on a side wall of the generally cylindrical section of the tip body and spaced above the circumferential contact surface portion such that the at least one vent opening is completely surrounded by material comprising the side wall, the at least one vent opening extending into the generally cylindrical section of the tip body;

wherein the at least one vent opening is in physical communication with a portion of the at least one channel, so that an unbroken fissure in the tip body resides as a structural breach extending between the generally cylindrical section side-wall entrance of the at least one vent opening and the physically communicative association of the at least one opening with the portion of the at least one channel, and wherein the at least one vent opening is large enough to prevent any significant change of pressure from occurring within the recess when the crutch tip is firmly pressed against a contact surface.

2. The anti-slip crutch tip apparatus of claim 1, wherein the tread structures include a plurality of ridges and a plurality of channels.

3. The anti-slip crutch tip apparatus of claim 2, further comprising a plurality of vent openings, each vent opening being located on the side wall of the generally cylindrical section of the tip body and extending into the generally cylindrical section of the tip body, wherein each vent opening is in physical communication with a portion of at least one channel of the plurality channels.

4. The anti-slip crutch tip apparatus of claim 3, wherein each vent opening of the plurality of vent openings is equidistantly spaced from other vent openings located on the side wall of the generally cylindrical section of the tip body.

5. The anti-slip crutch tip apparatus of claim 3, wherein the plurality of tread structures includes a plurality of concentric ridges spaced apart by a corresponding plurality of concentric channels.

6. The anti-slip crutch tip apparatus of claim 3, wherein a ridge of the plurality of ridges is integral with the side wall of the generally cylindrical section of the tip body, and wherein the integral ridge is concaved so that the outer-most edge of the concaved ridge resides as the extent of the second end of the tip body and forms a suction-cup-like recess of the contact surface portion of the second end of the tip body.

7. The anti-slip crutch tip apparatus of claim 3, wherein each vent opening of the plurality of vent openings extends toward the central axis of the generally cylindrical section of the tip body and each vent opening terminates prior to communicatively intersecting any other vent opening near the central axis.

8. A crutch support tip apparatus for preventing sideways slipping of a crutch support, the crutch support tip apparatus comprising:

a tip body, having a crutch leg receiving end, an opposing base support end, and a sidewall that extends between the crutch receiving end and the base support end, the crutch leg receiving end having a top axial opening configured to receive the leg of a crutch support, and the base support end having a bottom diameter that is larger than the diameter of the crutch leg receiving end;

a circumferential contact surface, located at the extent of the outermost diameter of the bottom of the base support end, the circumferential contact surface being concaved so that the outer-most edge of the concaved circumferential contact surface forms the perimeter of a suction-cup-like recess of the bottom of the base support end of the tip body; and a relief tunnel situated to extend through the structure of the tip body between the sidewall of the tip body, and being spaced above the circumferential contact surface such that the relief tunnel is completely surrounded by material comprising the sidewall, and a portion of a groove formed on the bottom of the base support end, wherein the groove is located radially within the diameter of the circumferential contact surface of the base support end, wherein the relief tunnel is structured to maintain an unbroken fissure in the tip body such that the relief tunnel prevents suction from occurring between the crutch tip and a crutch support surface upon which the crutch tip resides when the crutch tip is firmly pressed against the crutch support surface.

9. The crutch support tip apparatus of claim 8, wherein the bottom of the base support end includes a plurality of grooves.

10. The crutch support tip apparatus of claim 9, further comprising a plurality of relief tunnels, each relief tunnel being located to extend through the structure of the tip body between the sidewall of the tip body, above the circumferential contact surface, and a portion of a groove formed on the bottom of the base support end.

11. The crutch support tip apparatus of claim 10, wherein each relief tunnel of the plurality of relief tunnels is equidistantly spaced from other relief tunnels located to extend through the structure of the tip body between the sidewall of the tip body, above the circumferential contact surface, and a portion of a groove formed on the bottom of the base support end.

12. The crutch support tip apparatus of claim 10, wherein the plurality of grooves includes plurality of concentric channels spaced apart by a plurality of concentric ridges, each ridge within the outermost circumferential contact surface, itself being an outer ridge.

13. The crutch support tip apparatus of claim 10, wherein each relief tunnel of the plurality of relief tunnels extends toward the central axis of the base support end of the tip body and each relief tunnel terminates prior to communicatively intersecting any other relief tunnels near the central axis.

14. The crutch support tip apparatus of claim 10, wherein the tip body is formed of rubber-like material.

15. A method of preventing slipping of a crutch support device tip, the method comprising:

providing an anti-slip crutch tip apparatus including:

a tip body, having a first end and an opposing second end, wherein the first end of the tip body includes a crutch leg opening extending axially within a generally frustoconical section of the tip body, the crutch leg opening configured to receive a portion of a crutch leg, and wherein the second end of the tip body includes a surface contact portion located at the extent of a generally cylindrical section of the tip body, the surface contact portion having a circumferential contact surface being concaved so that the outer-most edge of the concaved circumferential contact surface forms the perimeter of a suction-cup-like recess of the extent of the generally cylindrical section of the second end of the tip body; and a relief tunnel situated to extend through the structure of the tip body between a sidewall of the generally cylindrical section of the tip body, and being spaced above the circumferential contact surface such that the relief tunnel is completely surrounded by material comprising the sidewall, and a portion of a groove formed on the surface contact portion, wherein the groove is located radially within the diameter of the circumferential contact surface of the second end of the tip body, wherein the relief tunnel is structured to maintain an unbroken fissure in the tip body such that the relief tunnel prevents suction from occurring between the crutch tip and a crutch support surface upon which the crutch tip resides when the crutch tip is firmly pressed against the crutch support surface;

compressing the circumferential contact surface of the tip body against the crutch support surface; and relieving pressure built-up under the suction-cup-like recess of the extent of the generally cylindrical section of the second end of the tip body by allowing the built-up pressure to escape through the relief tunnel extending between the groove formed on the surface contact portion and the sidewall of the generally cylindrical section of the tip body to prevent any significant change in pressure within the suction-cup-like recess and prevent suction between the crutch tip and the crutch support surface when the crutch tip is compressed against the crutch support surface, thereby preventing hydroplaning and sideways slippage of the crutch tip.

16. The method of preventing slipping of a crutch support device tip of claim 15, wherein the crutch support surface is a wet surface.

17. The method of preventing slipping of a crutch support device tip of claim 15, wherein the crutch support surface is an icy surface.

18. The method of preventing slipping of a crutch support device tip of claim 15, wherein the crutch support surface is a slick surface.

19. The method of preventing slipping of a crutch support device tip of claim 15, wherein the anti-slip crutch tip apparatus includes a plurality of relief tunnels.

20. The method of preventing slipping of a crutch support device tip of claim 19, wherein the plurality of relief tunnels are equidistantly spaced around the sidewall of the generally cylindrical section of the tip body.

21. An anti-slip tip for a support device comprising:

a tip body having a first end, a second end, and a sidewall extending between the first and second ends, wherein the first end is dimensioned to receive a cylindrical leg, wherein the second end has a substantially circular perimeter and a concaved contact surface located within the substantially circular perimeter, the contact surface including a circular channel substantially concentric about a center point of the contact surface;

a pressure relief tunnel extending through the sidewall, the pressure relief tunnel extending from a first opening in the side wall, the first opening spaced above the substantially circular perimeter such that the first opening is completely surrounded by material comprising the side wall; and a second opening connecting the pressure relief tunnel to the circular channel, the second opening and pressure relief tunnel configured to prevent any significant suction between the contact surface and a crutch support surface when the circular perimeter of the tip body is pressed against the crutch support surface.

22. The anti-slip tip for a support device of claim 21, further comprising a plurality of the pressure relief tunnels and corresponding openings.

* * * * *

UNITED STATES PATENT AND TRADEMARK OFFICE

CERTIFICATE OF CORRECTION

PATENT NO. : 7,748,396 B2
APPLICATION NO. : 12/124740
DATED : July 6, 2010
INVENTOR(S) : Lasota It is certified that error appears in the above-identified patent and that said Letters Patent is hereby corrected as shown below:

On the Title Page, Item (57) in the abstract, Line 6, after "tip body" insert -- . --

In the drawings, Sheet 1 of 5, Fig. 1, replace with attached drawing labeled Sheet 1 of 5, Fig. 1 (the reference numeral 18 should be applied to the "tread structures" element comprised of the "plurality of concentric ridges" element $16_{a\text{-}c)}$; Sheet 4 of 5, Fig. 4, replace with the attached drawing labeled Sheet 4 of 5, Fig. 4 (the reference numeral "$117_c$" should be changed to -- $117_b$ --)

Column 3, Line 21, after "tip 10 is" insert -- a --

Column 6, Line 22, after "ridge **116*a*** resides" replace "as" with -- at --

Signed and Sealed this

Fifth Day of October, 2010

David J. Kappos

David J. Kappos
*Director of the United States Patent and Trademark Office*

(Prior Art)